US012741177B2

(12) United States Patent
Koerner et al.

(10) Patent No.: US 12,741,177 B2
(45) Date of Patent: Sep. 22, 2026

(54) SYSTEM FOR DYNAMICALLY IMPLEMENTING A REHABILITATIVE SCHEMA

(71) Applicant: United States Performance Center, LLC., Charlotte, NC (US)

(72) Inventors: David Joseph Koerner, Charlotte, NC (US); Irwin Belk, II, Charlotte, NC (US)

(73) Assignee: United States Performance Center, LLC, Charlotte, NC (US)

( * ) Notice: Subject to any disclaimer, the term of this patent is extended or adjusted under 35 U.S.C. 154(b) by 55 days.

(21) Appl. No.: 18/581,242

(22) Filed: Feb. 19, 2024

(65) Prior Publication Data

US 2024/0286006 A1 Aug. 29, 2024

Related U.S. Application Data

(60) Provisional application No. 63/499,217, filed on Apr. 29, 2023, provisional application No. 63/485,891, filed on Feb. 18, 2023.

(51) Int. Cl.

| | |
|---|---|
| ***A63B 24/00*** | (2006.01) |
| ***A63B 23/035*** | (2006.01) |
| ***A63B 71/06*** | (2006.01) |

(52) U.S. Cl.

CPC .... *A63B 24/0075* (2013.01); *A63B 23/03516* (2013.01); *A63B 24/0062* (2013.01); *A63B 2024/0093* (2013.01); *A63B 2071/0652* (2013.01); *A63B 2220/30* (2013.01); *A63B 2220/50* (2013.01)

(58) Field of Classification Search

CPC ..... A63B 24/0075; A63B 23/03516; A63B 24/0062; A63B 2024/0093; A63B 2071/0652; A63B 2220/30; A63B 2220/50; A63B 21/00181; A63B 21/4035;

(Continued)

(56) References Cited

U.S. PATENT DOCUMENTS

2011/0294624 A1* 12/2011 Burnfield ..... A63B 21/00181 482/145
2014/0274565 A1* 9/2014 Boyette ..... A63B 22/0694 482/6

(Continued)

*Primary Examiner* — Sundhara M Ganesan
(74) *Attorney, Agent, or Firm* — Kim and Lahey Law Firm, LLC; Douglas W. Kim

(57) ABSTRACT

This system can be a combination of hardware and equipment, software, training methodologies, data feedback loops and methods of instruction and activity so that physical and mental stimulation for recovery of neurologic and neuromuscular impairments can be quickly designed and implemented to promote neuroplasticity. This system involves evaluations and individualized training prescriptions that are automatically and continuously modified according to changes in the patient's performance measures. This system also includes assistance, instructions, and biofeedback that can accompany training for maximal voluntary activation of the central nervous system to promote greater functionality. This system can also train involuntary activation by using electrical or magnetic stimulation. In one embodiment, this system is not passive, but rather directly targets the nervous system that can meet the patient at their current ability levels.

20 Claims, 9 Drawing Sheets

(58) Field of Classification Search
CPC ..... A63B 2220/54; A63B 2225/50; A63B 24/0087; A63B 21/0058; A63B 2220/51
See application file for complete search history.

(56) References Cited

U.S. PATENT DOCUMENTS

| | | | | |
|---|---|---|---|---|
| 2020/0086197 | A1* | 3/2020 | Kim | A63B 23/1218 |
| 2020/0289880 | A1* | 9/2020 | Hacking | A63B 22/0664 |
| 2020/0360764 | A1* | 11/2020 | Smith | A63B 21/00178 |
| 2022/0016484 | A1* | 1/2022 | Bissonnette | A63B 23/0417 |
| 2022/0047921 | A1* | 2/2022 | Bissonnette | A63B 24/0006 |
| 2022/0126169 | A1* | 4/2022 | Mason | A63B 24/0062 |
| 2022/0288460 | A1* | 9/2022 | Mason | A61B 5/1071 |
| 2022/0401794 | A1* | 12/2022 | Bissonnette | G06N 20/00 |
| 2023/0058605 | A1* | 2/2023 | Mason | G16H 50/70 |
| 2023/0072368 | A1* | 3/2023 | Mason | A63B 24/0087 |
| 2023/0245747 | A1* | 8/2023 | Rosenberg | G16H 50/30 705/3 |
| 2023/0253089 | A1* | 8/2023 | Rosenberg | A63B 24/0087 705/3 |
| 2023/0377711 | A1* | 11/2023 | Rosenberg | A63B 24/0062 |
| 2023/0377712 | A1* | 11/2023 | Rosenberg | G16H 15/00 |
| 2023/0381592 | A1* | 11/2023 | Ellzey | A63B 71/0622 |
| 2024/0024731 | A1* | 1/2024 | Rosenberg | A63B 71/0622 |
| 2024/0062869 | A1* | 2/2024 | Rosenberg | A63B 22/0605 |
| 2024/0062870 | A1* | 2/2024 | Rosenberg | A63B 22/0605 |
| 2024/0136041 | A1* | 4/2024 | Rosenberg | G16H 20/30 |
| 2024/0266022 | A1* | 8/2024 | Rosenberg | A63B 21/00181 |
| 2025/0205557 | A1* | 6/2025 | Mason | G16H 10/60 |

* cited by examiner

SYSTEM FOR DYNAMICALLY IMPLEMENTING A REHABILITATIVE SCHEMA

RELATED APPLICATIONS

This application claims priority from U.S. Provisional Patent Application 63/485,891 (filed Feb. 18, 2023) and 63/499,217 (filed Apr. 29, 2023) each incorporated by reference.

BACKGROUND OF THE INVENTION

1) Field of the Invention

This invention is directed to a system and method of dynamically measuring, determining, modifying, and implementing a rehabilitative schema directed to individuals in need of injury recovery.

2) Description of the Related Art

While modern technologies and innovations have greatly increased, including in the health care industry, there is still many medical diseases and events that do not have adequate preventions, remedies, treatments, recoveries, and rehabilitations. One area that continues to see a need for improved rehabilitation and recovery technologies are the negative impacts of neuromuscular or neurologic disease or injury. Areas that need improvement include injuries and undesirable impacts of stroke, neurodegenerative disorders, undesirable results from surgeries and repairs (e.g., ACL repair, meniscus repair, tendon repair, nerve repair, etc.), non-surgical injuries resulting in nerve blocks and the like. These undesirable results need improved technologies, treatments, processes, and procedures to remedy these results. In one example, one of the top causes of death in adults, a stroke is also one of the top causes of serious disabilities in survivors. For stroke survivors, the principal goal of stroke rehabilitation is to reduce brain injury, systemic trauma and other injuries as well as promote maximum patient recovery and improved quality of life.

Generally, a stroke is defined as a disease that occurs when the brain's blood supply is unnaturally interrupted. Such interruptions can result due to several factors that include blood clots and hemorrhages. Generally, strokes fall into two categories: ischemic and hemorrhagic. An ischemic stroke is when the blood supply to the brain is stopped which prevents the brain from receiving oxygen and nutrients. A hemorrhagic stroke is when bleeding from a ruptured blood vessel in the brain causes unwanted buildup that can result in damage and the killing of brain tissue. In either case, permanent brain damage can result.

Even with immediate medical attention, a stroke survivor, and others affected by neuromuscular or neurologic disease or injury can suffer minor to major disability that almost always include impairment of more than one normal function such as loss of voluntary motor functions and diminished power production on one side of the body, loss of speech, loss of awareness, increased exhaustion, increased frustration, and depression. Several disabilities can include the loss of bladder and bowel functions, mobility and even the ability to swallow. A well developed and properly implemented stroke recovery program can significantly reduce the risks associated with stroke disabilities, substantially reduce the recovery time and improve functional capabilities ultimately improving their quality of life. Therefore, such a system in this area is much needed for the improvement of the health and quality of life for stroke victims.

Rehabilitation after a neuromuscular or neurologic disease or injury can take many forms and can include physical therapy, physical exercise (e.g., range-of-motion and stretching), relearning skills such as walking and eating, a continued exercise program and psychological counseling. It is believed that an early and intensive rehabilitation program increases the patient's chances of improving and restoring functions post-neuromuscular or neurologic disease or injury. It is also believed that a proper rehabilitation program can facilitate and improve neuroplasticity.

Neuroplasticity is generally the brain's ability to modify, change, and adapt to the environment and through new experiences, reorganizing neuron pathways, creating new connections between neurons, and potentially creating new neurons. Therefore, the response to stimuli is developed and modified according to environmental and experiential factors. Neuroplasticity includes changes to the brain's function which can include relocating functions from a damaged portion of the brain to an undamaged portion. Neuroplasticity also includes the brain's ability to change its physical structure which can be associated with learning.

In patients recovering from other neurological or neuromuscular impairments such as an ACL surgical repair there is often a significant loss of strength and power output in the impaired limb. Historically, physical therapy and rehabilitation has been used that seeks to improve mobility and strength so that the patient can return to pre-impairment activities. However, substantial decrements in nervous system efficiency exist when patients are "cleared" from their standard rehabilitation programs. As a result of this incomplete rehabilitation protocol, patients with these surgeries have very high rates of reinjury, especially in those injuries that are associated with a return to high-risk activities, such as sports. There is a need to further evaluate and improve the neurological deficits that result from disorders, diseases, injuries, and surgeries including those stemming from neuromuscular or neurologic disease or injury.

Physical, occupational, and speech therapy are designed to facilitate neuroplasticity and encourage the brain to correct any mental and physical injuries or deficits resulting from a stroke. Further, it is believed that the brain also temporarily increases its natural neuroplasticity in response to traumatic damage, such as a stroke, which makes developing and beginning a proper rehabilitation program shortly after a stroke, or other injury, advantageous. Further, the damage to a brain for each stroke victim is unique so that the recovery process should be unique as well. The brain uses about 100 trillion neural connections or pathways to store and retrieve information. A neuromuscular or neurologic disease or injury, including a stroke, can negatively affect any combination of these connections so that there is no way to predict the impact and there is no single recovery or rehabilitation process that applies to each recovering individual. The brain and the central nervous system can identify environmental, behavioral, and neural damage, but cannot autonomously determine the stimulation needed for neuromuscular or neurologic disease or injury recovery.

There have been some attempts to develop stroke rehabilitation systems that use feedback from the exoskeleton of the stroke survivor such as found in U.S. Pat. No. 11,141,341. This reference uses a dual glove exoskeleton system and method for rehabilitation that states that it is designed to increase recovery through optic, neural, and muscular stimulation. This reference state that it includes determining a position of a healthy extremity by at least one sensor; determining a position of the impaired extremity by the at least one sensor; and directing a patient to attempt to mirror the position of the impaired extremity with the position of the healthy extremity. Further, the device, using gloves, determines positioning that is affected by gravity so that the measurements include not just the motion of the patient, but also how the patient reacts to gravity.

Another attempt to provide a stroke patient rehabilitation training device is shown in U.S. Pat. No. 9,549,866 that states that it includes a first component that is operatively coupled to a first body part (unaffected body part) of the patient and a second component that is operatively coupled to a second body part (affected body part) of the patient. The first component and second component are operatively coupled to one another such that motion of the first component as a result of movement of the first body part by the user causes the second component and second body part to move in a symmetrical motion. This device also includes gravity. Further, this device is designed to externally move the affected body-part with passive motion rather than retaining the affected body part and states that it harnesses brain activity from the unaffected side.

Further research is needed for a comprehensive system that optimizes how a neuromuscular or neurologic disease or injury survivor functions so that an improved level of independence and quality of life is achieved. In the case of a stroke and other neuromuscular or neurologic diseases or injuries, it has been reported that rehabilitation should begin within 48 hours after the disease or injury, making the ability to create and implement a custom rehabilitation scheme important to the future of the survivor.

Therefore, it is an object of the present system to provide physical and mental stimulation for neuromuscular or neurologic disease or injury recovery that can be quickly designed and implemented.

It is another object of the present system to provide physical and mental stimulation for facilitating neuroplasticity.

It is another object of the present system to provide for physical and mental stimulation for facilitating neuroplasticity that includes real-time modifications to the rehabilitation scheme according to the progress of the patient as each patient's condition is unique.

BRIEF SUMMARY OF THE INVENTION

The above objectives are accomplished by providing a system for dynamically implementing a rehabilitative schema comprising: an exercise machine having a load assembly for applying a load to a limb of a patient; a force/load sensor in electrical communications with the force/load sensor for determining the force/load applied to the limb and the patient uses the exercise machine; a velocity sensor for receiving velocity information representing the force applied to the load by the patient; and, computer system in communications with the sensors for determining base line power, receiving load information, receiving velocity information and determining modifications in the load applied to the patient. This information can be used to form a feedback system allowing each iteration of, the achieved results and sensors data to impact and modify the subsequent treatment programs providing a biofeedback loop for treatment. The system can include computer readable instructions that can sense and receive patients information about the biomechanics and performance of the patient in light of the treatment program, determine the improvements or changes in the patient's biomechanics and performance, use trends, machine learning, algorithms, and other data analysis to propose or make modifications to the treatment programs thereby providing a feedback mechanism (e.g., biofeedback) to assist with improving the treatment, treatment program and the patient's outcome.

The computer readable instructions can determine performance metrics such as estimated maximal load, peak power, and power velocity and symmetry comparisons between limbs. The computer readable instructions can determine an initial status of the patients, an initial workout scheme according to the data received from the sensors and subsequently modify that workout scheme according to the data received from the sensors. The workout scheme can be determined using an iterative process from data from the recent workouts. The computer readable instructions can be adapted for receiving load information, receiving velocity information, and determining modifications in the load applied to the patient are repeated for each patient session. The workout scheme can be determined according to the data received from the sensors and a patient's characteristics. The computer readable instructions can determine a workout scheme according to the data received from the sensors and a dataset of prior patient characteristics as well as wherein the patient characteristics match those of another patient characteristics in the dataset.

The system for dynamically implementing a rehabilitative schema for neuromuscular and neurologic disease and injury can include an exercise machine having a load assembly for applying a first load to a first limb of a patient and a second load to a second limb of the patient; a first load sensor adapted to determine a first force applied by the first limb by the patient; a second load sensor adapted to determine a second force applied by the second limb by the patient; a first velocity sensor for receiving a first velocity information associated with the first force; a second velocity sensor for receiving a second velocity information associated with the second force; and, computer system in communication with the first load sensor, the second load sensor, the first velocity sensor, the second velocity sensor and adapted to determine a base line power for the first limb and the second limb according to the first force, the second force, the first velocity information, and the second velocity information receive an initial treatment program, and determine a modification to the initial treatment program according to receiving a subsequent force and a subsequent velocity information.

The computer system can be adapted to determine an estimated maximal load, determine a peak power and power velocity, determine a peak power and a power velocity for each limb, determine the modification of the initial treatment program according to an iterative process using a set of date received from the first load sensor, the second load sensor, the first velocity sensor and the second velocity sensor to provide a subsequent treatment program, repeat an iterative process for each subsequent patient workout session, determine the initial treatment program according to a patient's characteristics, determine the initial treatment program according to a dataset of prior patient characteristics, and determine the initial treatment program according to a record from a past patient dataset wherein a current patient characteristic matches a prior patient characteristic in the past patient dataset.

The can include an exercise machine having a load assembly for applying a first load and a second load; a sensor assembly adapted to measure a performance dataset that include a first force and a second force placed laterally against the first load and the second load by a patient using the exercise machine and a first velocity and a second velocity associated with the first force and the second force; and, a computer system in communication with the sensor assembly adapted to determine a base line power according to the performance dataset, create an initial treatment program, and determine a modification to the initial treatment program according to receiving a subsequent dataset from the sensor assembly.

The system can determine performance metrics according to the performance dataset and the subsequent dataset, determine a symmetrical comparison between a first limb and a second limb, determine the modification to the initial treatment program according to a determination of a peak power, a power velocity, a symmetry comparison, and any combination thereof.

The system can include a sensor assembly adapted to determine a performance dataset that include a first force and a second force placed on the exercise machine applied by the patient and a first velocity and a second velocity associated with the first force and the second force; and, a computer system in communication with the sensor assembly adapted to determine a base line power according to the performance dataset, create an initial treatment program, and determine a modification to the first load and the second load according to receiving a subsequent dataset from the sensor assembly. The system can vary the first load according to the modification to the first load. The modification to the first load can be according to a determination of a peak power, a power velocity, a symmetry comparison, and any combination thereof. The modification to the first load can be iterative until an alignment of a right power velocity calculation and a left power velocity calculation occurs.

BRIEF DESCRIPTION OF THE SEVERAL VIEWS OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF THE INVENTION

With reference to the drawings, the invention will now be described in more detail. This system can be a combination of hardware and equipment, software, training methodologies, data feedback loops and methods of instruction and activity so that physical and mental stimulation for neurological and neuromuscular recovery that can be quickly designed and implemented to promote neuroplasticity. This system also includes assistance and instructions that can accompany training for maximal voluntary activation of the nervous system to promote greater functionality. This system can also train involuntary activation by using electrical or magnetic stimulation. In one embodiment, this system is not passive, but rather directly targets the nervous system that can meet the patient at their current ability levels.

Figure 1:
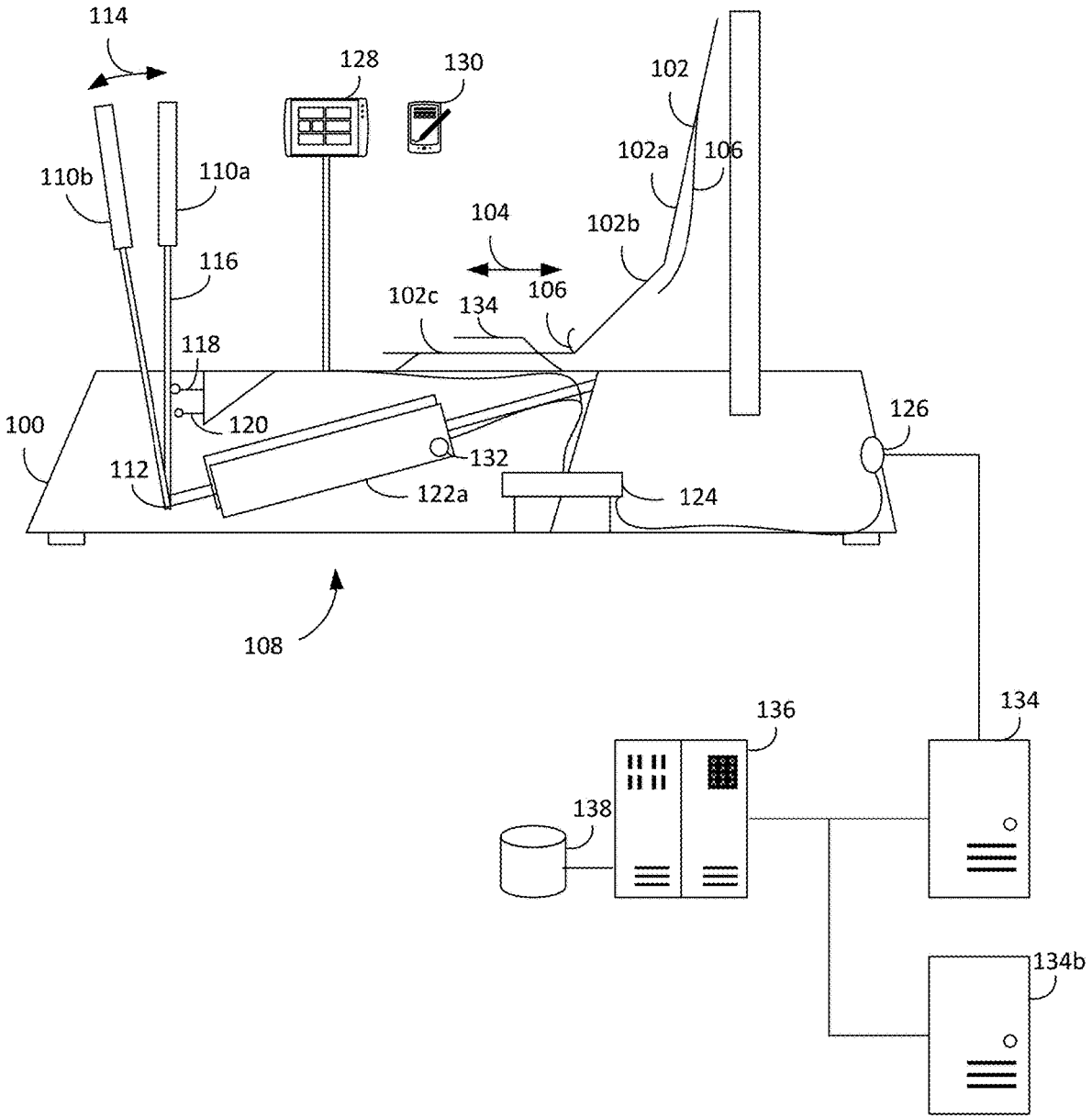
FIG. 1 is a schematic of a machine that can be used with the system.

Referring to FIG. 1, exemplary fitness equipment is shown having a base 100 that can support a seating assembly 102. The seating assembly can support a patient and can be positioned along path 104 for consideration of varying torso length, leg lengths and overall heights of the patient. In one embodiment, the seat can have section 102*a* through 102*c* that can be rotated relative to each other to change the sitting angle of the patient. The seat or frame can include security straps 106 or other security assembly (e.g., straps, bars) to secure the patient into the seat and prevent unintentional falling or other motion in the seat.

The frame can include a resistance assembly 108 that can, in this embodiment, can be connected to a foot pedal 110*a* wherein the foot pedal is configured to move along a pivot 112 allowing the patient foot to travel along path 114. The frame can carry a second foot pedal 110*b* allowing for independent movement between the first foot pedal 110*a* and the second foot pedal 110*b* allowing for unilateral and bilateral movement of the patient's feet and legs. The foot pedal can include a foot pedal shaft 116 that can contact a first stop 118 so that the initial position of the foot pedal away from the patient can be adjusted. Each pedal can connect to a second stop 120 so that there is a minimum distance that the foot pedal can be from the patient preventing the foot pedal from over traveling toward the patient.

A load assembly 122*a* can be connected to the first foot pedal or each pedal. The load assembly can be a variable load assembly so that the resistance provided to the patient can be varied by the variable load assembly. The load assembly can be set to a specific value or can have a graduating value according to factors such as the speed the patient to pressing the load, the number of repetitions in a particulate period, reversal strength, deceleration, and the like. The load assembly can include a controller 124 that can vary the load of the load assembly. The load can be varied automatically with computer readable instructions on the controller, information received from a communications port 126 or input from an input device such as a keyboard, touch screen 128 or portable device 130 in communications with the controller. The load assembly can be an air cylinder, motor, fly wheel with variable resistance, transmission, and the like. The load assembly can provide resistance to the foot pedal and therefore the patient without the impact of gravity. For example, when input is received at the controller, the resistance of the load assembly varies without consideration of gravity which is in opposition to traditional exercise equipment such as free weights.

The controller can also be connected to one or more sensor 132 that can gather information about the exercise machine and its components, the activities, and the patient. For example, a sensor can determine the force placed on the foot pedal, the distance that the foot pedal travels, lateral force paced on the foot pedal, the speed in which the foot pedals travels, the acceleration of the foot pedal, repetitions and the like. A sensor can be included within an air cylinder, piston, or the like to measure compressive or pressure forces or the like. A sensor can be included in the seat to determine the weight of the patient and the force against the seat. A sensor can determine the gripping force of the patient on a handle 134 including forward, rearward, and lateral force placed on the handle. One or more sensors can transmit the information to the controller which can be used to display on a screen 128 or portable device 130. In this example, exercise associated with the lower portion of the body is described. The equipment can be used for one or both legs.

The controller can be connected to a server 134, which can be local or remote. The controller can be in communications wirelessly, wired, local network, wide area network of global communications network. Information can be transmitted to and from the server and the controller. The server can be in communications with an aggregate server 136 and database 138 that can also be in communications with additional servers 134*b*. The controller can include a computer readable medium for data storage, can be in communications with a local or remote data storage system and can include a removable data storage system.

The controller of each machine, or a computer system in communications with the machine, can detect through sensors and display locally or remotely information that includes force, load, velocity, vectors, acceleration, power, distance, speed, repetitions, range of motion and the like. The system can measure each of these unilaterally or bilaterally. In one embodiment, the system measures these unilaterally so that each limb or direction is measured independently. The system can receive data from a plurality of exercise machines so that the analysis and functionality of the system can be based upon multiple data sources for the limb, including the comparison of a first limb to the second limb allowing for lateral analysis.

Figure 2:
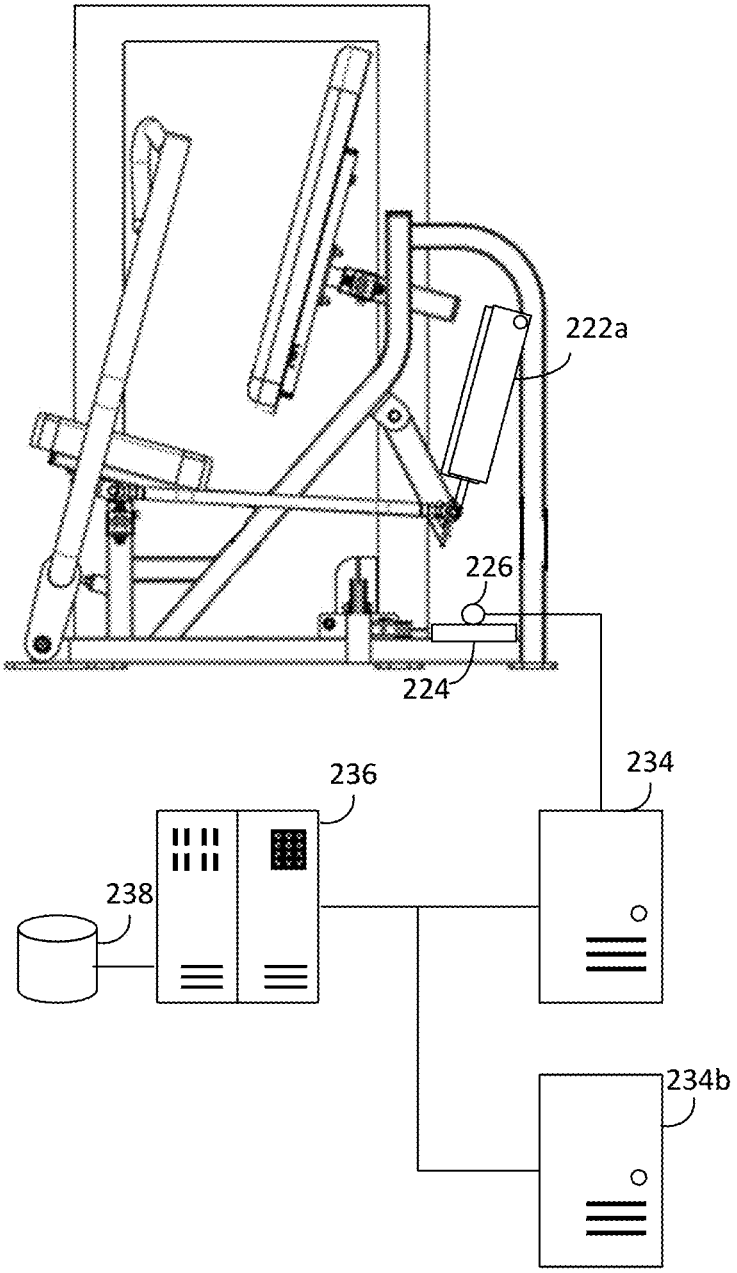
FIG. 2 is a schematic of a machine that can be used with the system.

Referring to FIG. 2, the seated chest press machine is shown. A load assembly 222*a* can be connected to a first chest press bar or each press bar. The load assembly can include a controller 224 that can vary the load of the load assembly. The load can be varied automatically with computer readable instructions on the controller, information received from a communications port 226 or input from an input device such as a keyboard, touch screen or portable device in communications with the controller. The load assembly can be an air cylinder, motor, fly wheel with variable resistance, transmission, and the like. The load assembly can provide resistance to the chest press bar and therefore the patient without the impact of gravity. For example, when input is received at the controller, the resistance of the load assembly varies without consideration of gravity which is in opposition to traditional exercise equipment such as free weights. In one embodiment, the equipment can include adjustment to meet the needs of the user, such as seat height, handle positions and the like.

Controller 224 can be connected to server 234. The server can be in communications with an aggregate server 236 and database 238 that can also be in communications with additional servers 234*b*. The controller can include a computer readable medium for data storage, can be in communications with a local or remote data storage system and can include a removable data storage system.

Figure 3:
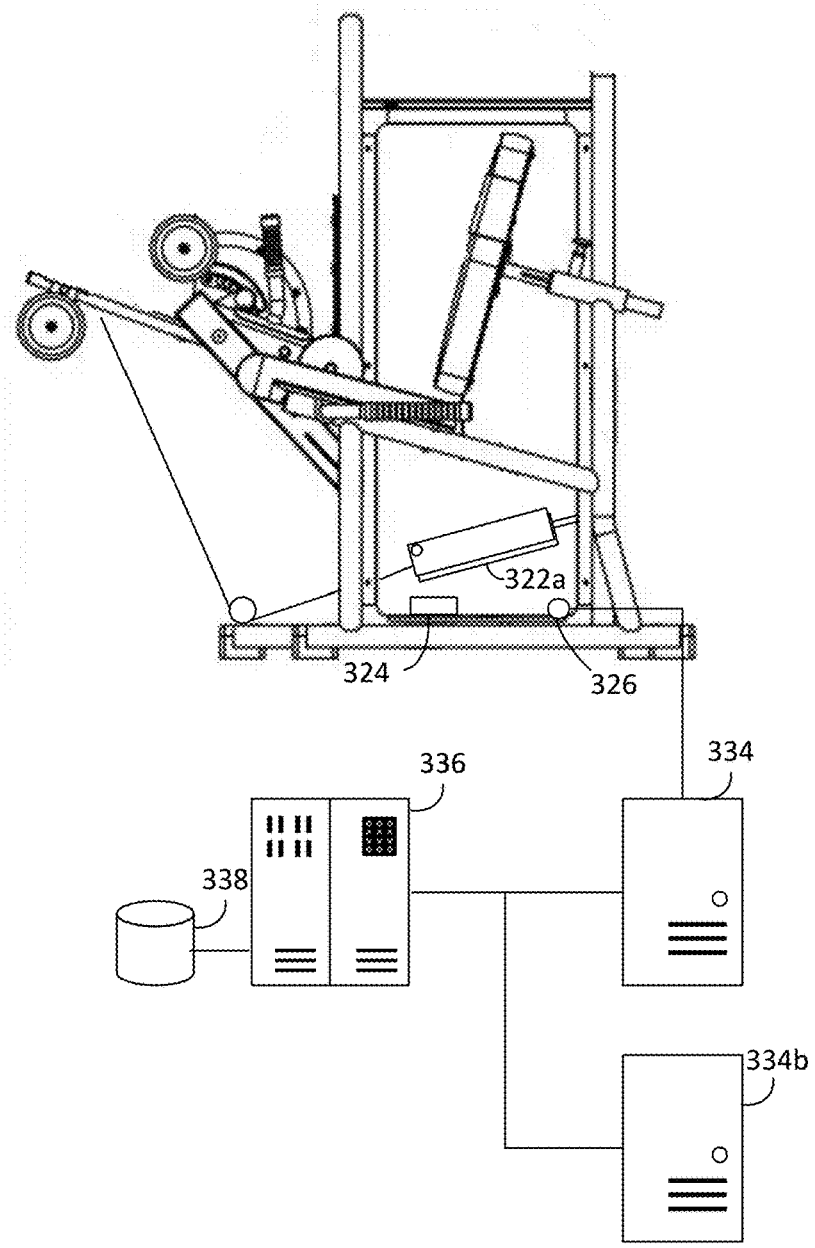
FIG. 3 is a schematic of a machine that can be used with the system.

Referring to FIG. 3, the leg curl machine is shown. A load assembly 322*a* can be connected to a leg curl bar and can be included for each limb. The load assembly can include a controller 324 that can vary the load of the load assembly. The load can be varied automatically with computer readable instructions on the controller, information received from a communications port 326 or input from an input device such as a keyboard, touch screen or portable device in communications with the controller. Controller 324 can be connected to server 334. The server can be in communications with an aggregate server 336 and database 338 that can also be in communications with additional servers 334*b*. The controller can include a computer readable medium for data storage, can be in communications with a local or remote data storage system and can include a removable data storage system.

Figure 4:
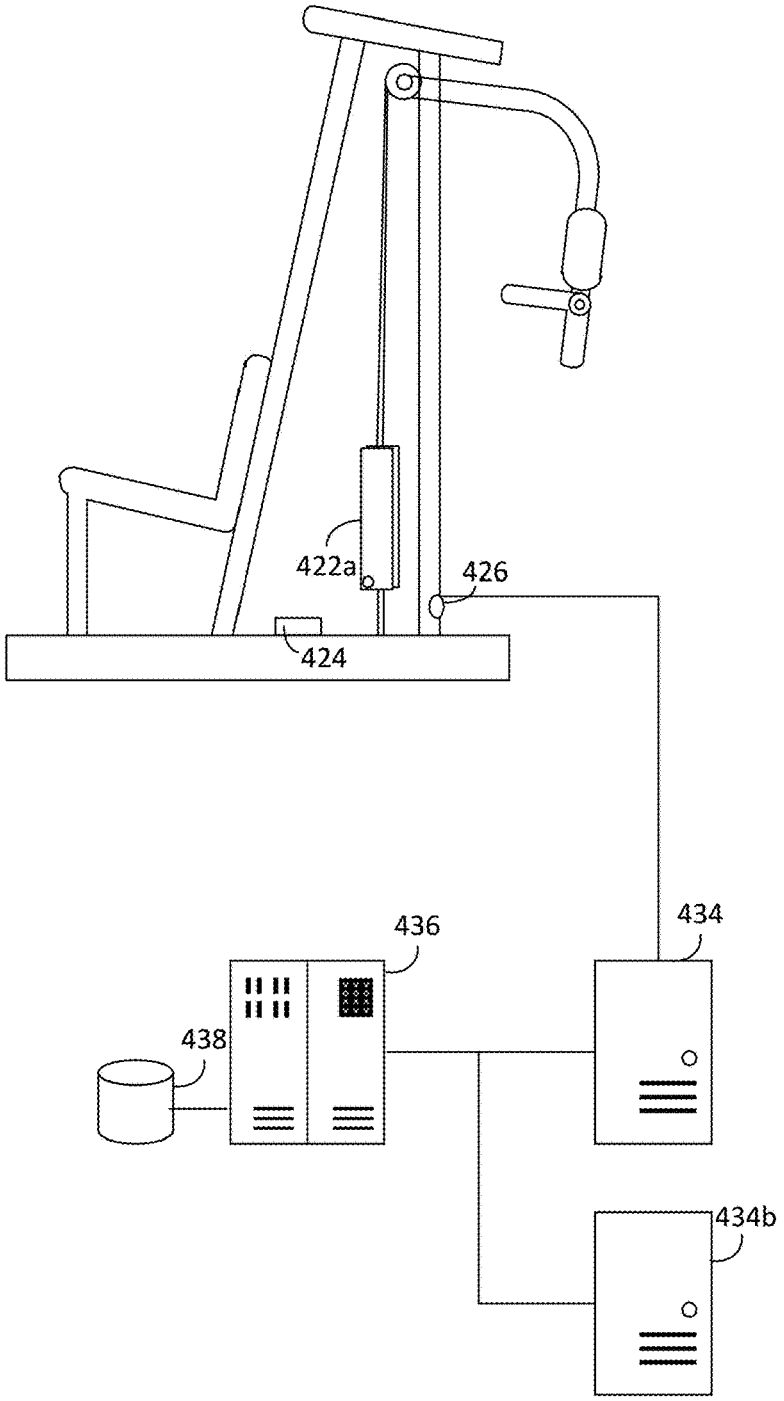
FIG. 4 is a schematic of a machine that can be used with the system.

Referring to FIG. 4, the upper back machine is shown. A load assembly 422*a* can be connected to a pull bar for each limb. The load assembly can include a controller 424 that can vary the load of the load assembly. The load can be varied automatically with computer readable instructions on the controller, information received from a communications port 426 or input from an input device such as a keyboard, touch screen or portable device in communications with the controller. Controller 424 can be connected to server 434. The server can be in communications with an aggregate server 436 and database 438 that can also be in communications with additional servers 434*b*. The controller can include a computer readable medium for data storage, can be in communications with a local or remote data storage system and can include a removable data storage system.

While specific machines are used for illustrative purposes, the invention is not limited to a particular machine or machine configuration. For example, the leg curl machine can be one where the user is seated or in a prone position. Other exercise machines can be used such as deadlift, squat, pull down bar, ergometer, cable biceps, hanging leg raise, seated dip, chest fly, bench press, arm curl, arm extension, triceps press, triceps extension, shoulder press, overhead press, lateral raise, back extension, lat. pull, glute ham developer (GHD) machine, front pull, abdominal crunch, leg raise, rotary torso, rowing, cycle, and any number of exercise equipment. In one embodiment, an exercise machine can be modified to provide for the ability to measure patient performance and use for each side independently. Unilateral sensors can allow for independent readings so that a comparison between limbs can be made.

Figure 5A:
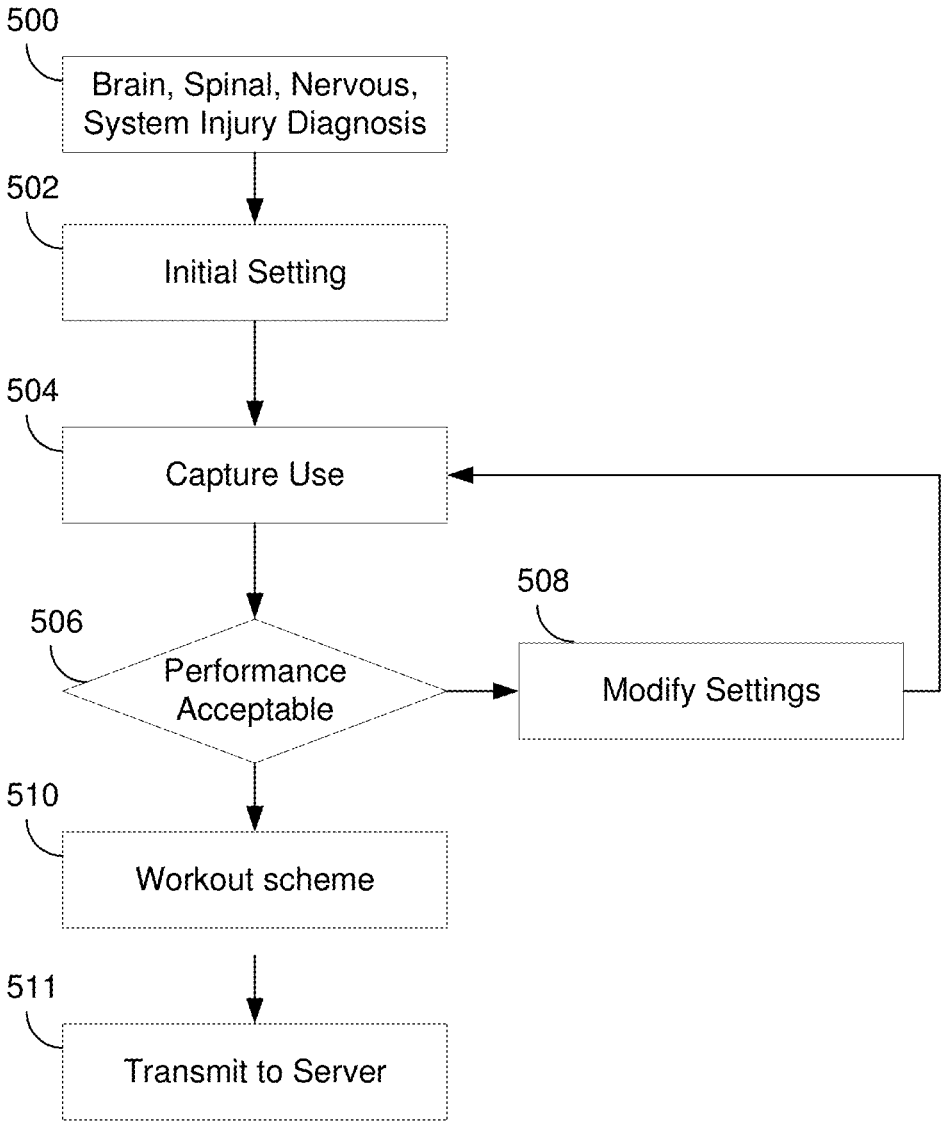
FIG. 5A is a flow chart of aspects of the present system.

Referring to FIG. 5A, components and the processes of the present system are shown in further detail. The system is designed for both evaluation and training and allows for continued monitoring and real-time adjustments to the patient's program to provide the appropriate stimulus needed for adaptation. In one application, the system can be used to determine an initial status or evaluation of the patient and provide an initial workout scheme. The initial workout scheme can be a suggested scheme or actual scheme. The health care assistant can review the initial workout scheme and modify it if needed according to the specific characteristics of the patients. The functionality of the hardware and the computer readable instructions provide for a system that can begin with a diagnosis of an injury that causes neuromuscular impairment, such as stroke, spinal injury, accidents, falls, sports injuries, and other trauma. The patient can then work with a healthcare provider or other professional to develop an initial setting according to a diagnosis 500 that be due to an injury, including stroke, and the like. At 502 the initial setting can be established according to the injury and the patient. For example, if a determination is made that the injury is severe, the initial load on the patient can be very light. Further, the system can access a database of prior patients and retrieve initial setting from patients that had similar injuries and similar criteria (e.g., age, weight, physical activity, physical shape, lifestyle, and the like). The patient can then use the machine with the initial settings and the data is captured at 504. In the event that the initial setting results in inadequate performance (e.g., the load was too high) a determination can be made at 506 and the setting can be modified at 508. If the performance is acceptable, the system generates a baseline where the workout scheme and rehabilitation plan begin at 510. The information, including the initial workout scheme can be transmitted to a server at 511. Information and inputs can be transmitted to and from the system from a remote device during the process. Further, the remote device can be used to monitor the activity of the system and the patient during the process.

Figure 5B:
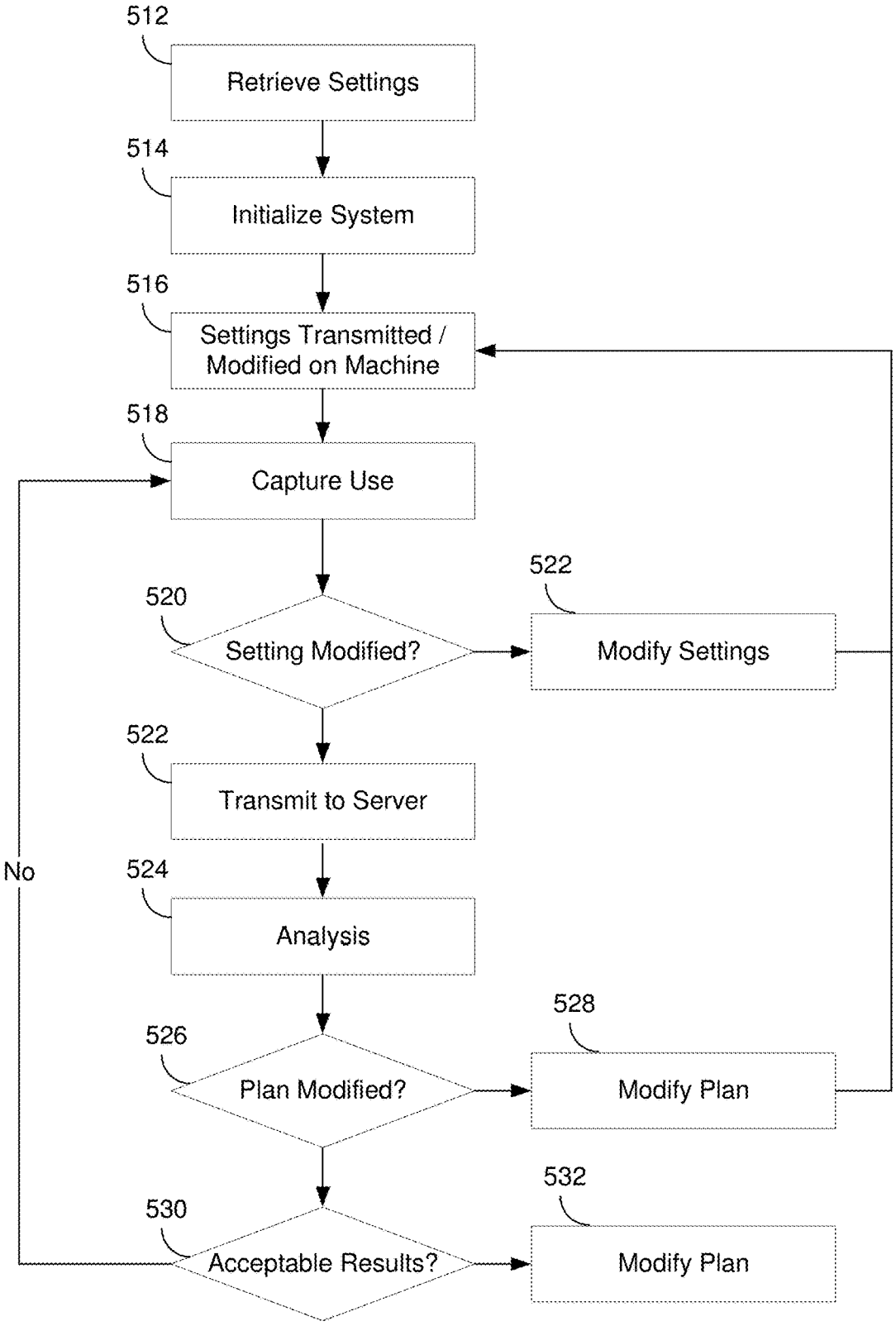
FIG. 5B is a flow chart of aspects of the present system.

Referring to FIG. 5B, the system can be used to facilitate and continue the rehabilitation and workout scheme. The most recent settings are retrieved at 512 and the machine is initialized according to these settings at 514. The patient can then use the machine at 518 and information from such use can be gathered. When the patient uses a machine, the patient information can be associated with that session. The controller can receive a patient identification that can be alpha-numeric or other information and can include features such as keycard, fingerprint, facial recognition, alphanumeric code, and the like for signing on to the machine and session. Once the patient signs in, the setting and the hardware and equipment configuration can be set, including seat, resistance, display format, position of components of the equipment and the like.

In one embodiment, a determination can be made that based upon the gathered information, do the setting need to be modified for the next repetition at 520. If so, the modifications are made at 522. Variation in the modifications can include progressive load modifications, static load modification between sessions, or any combination. The user of the machine can be transmitted to one or more servers at 522.

The server can include computer readable instructions that analyze the information gathered at 524, determine if modifications to the workout scheme and rehabilitation plan are needed at 526 and if so, modify the workout scheme and rehabilitation plan at 528 for the next set, next session, next iteration, and the like for the patient.

The system can be used for one or more rehabilitation plans can include one or more machines and the initial setting for the one or more machines. For example, a leg press machine can be selected for a diagnosis that includes rehabilitation of a leg and the rehabilitation plan can include an initial resistance setting for that patient. In one embodiment, if the results from the patent are acceptable at 530 the rehabilitation can be ended at 532.

Computer readable instructions can be included in the controller, server, aggregate servers, or portable device that can be configured to determine and display and report information using the gathered data from assessments and training sessions. The computer readable instructions can determine information described herein (e.g., resistance, velocity, force, power and the like) which can be displayed on a display or remote device. The results from the system can be used to create a load-velocity profile and power curve that can be associated with a patient, date, time, repetition, set, session and the like. In calculating the velocity, the following equation can be used:

$$v = \frac{d}{t}$$

where v is the velocity, d is the change in distance and t is the change in time so that velocity is calculated by determining the distance that the foot pedal traveled and determine a period when the foot pedal traveled from an initial position to a final position and can be measured in length units per time units. The computer readable instructions can also calculate the force that is applied by the patient. The force can be represented by the following equation:

$$F = m * a$$

where F is the force, m is the mass and a is the acceleration. The mass can be determined by translating the resistance into mass and the acceleration can be determined by the following equation:

$$a = \frac{\Delta v}{\Delta t}$$

where a is acceleration, Δv is the change in velocity over the change in time, Δt. The computer readable instructions can determine power from the following equation:

$$P = \frac{W}{\Delta t}$$

where power P is calculated by diving work, W, in the change in time Δt. Work can be calculated by the following equation:

$$W = Fs$$

where work, W can be calculated from force times displacement wherein displacement s represents the change in the position of the foot pedal. In the example, of a foot pedal, the displacement can be the arc that the foot pedal travels around the pivot as well as the line between the starting point and the ending point. The computer readable instructions can generate the power curve by determining the power, such as in watts, over the course of several repetitions performed at different load intensities.

This system allows for the use of bilateral and unilateral strength and power tests to measure left and right limbs performing repetitions at the same time or completely independently. The system can analyze data from strength and power assessments to make comparisons between current and ideal levels of strength, peak power, and power velocity and each of these measurements can be identified for each limb and compared. Differentials (differences in performance between limbs) can be calculated for strength, peak power, power velocity and averages can be taken across multiple data points. In one embodiment, especially in regard to stroke patients, the performance of a first limb is compared with a second limb (e.g., left vs. right) and the levels and differentials between the two are determined and categorized. The evaluation as generally described in FIG. 5A provides baseline metrics that can be used to create training programs aimed at promoting improved neuromuscular performance and symmetry between limbs. Data from training sessions is continually collected and analyzed in order to make appropriate changes to the exercise prescription based off of their performance. As a patient uses the system, more data is collected, and that system can provide better predictive analytics. Therefore, the patient benefits from an improved data set and the system can employ machine learning to better develop recommendations for a rehabilitation plan as well as continually modify the rehabilitation plan itself.

In one embodiment, the sensors and controller include an output of data without calculations. In this case, the controller serves as a data source for computer readable instructions that can be disposed locally or remote to the equipment.

Figure 6:
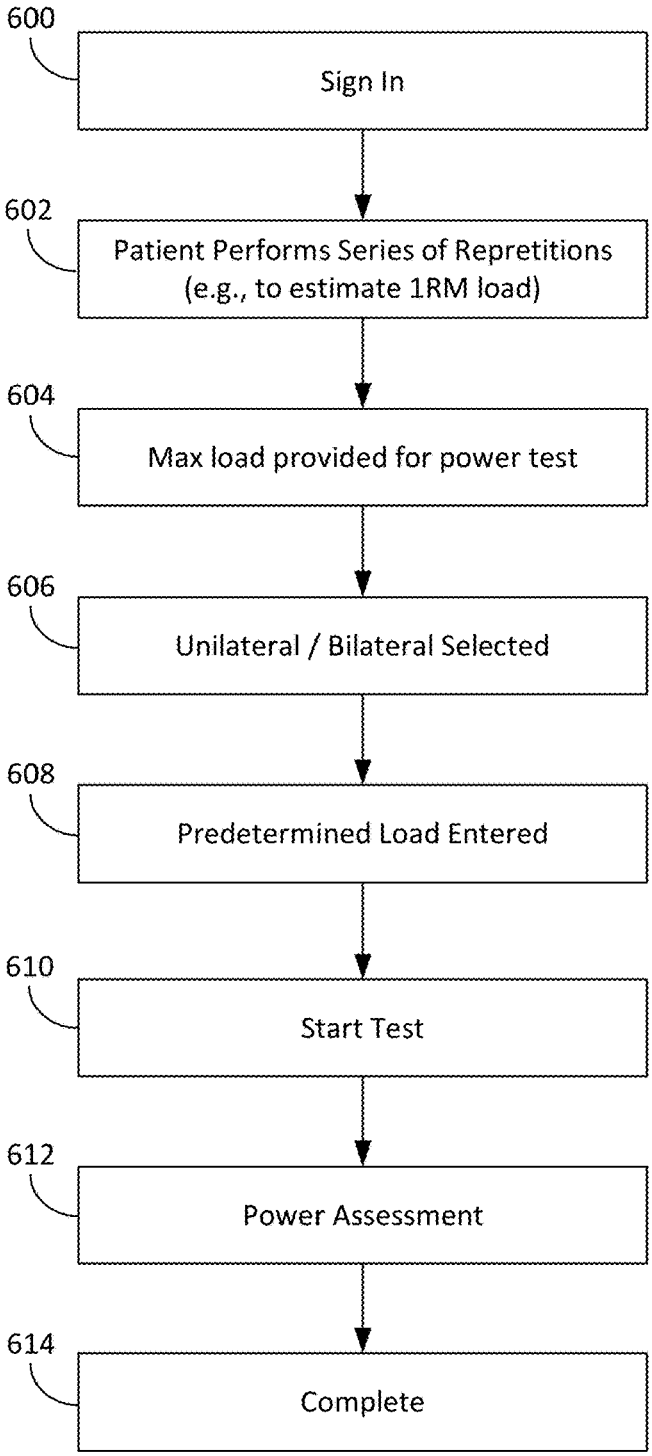
FIG. 6 is a flow chart of aspects of the present system.

Referring to FIG. 6, the computer readable instructions can determine a strength and power assessment for the patient using one or more machines. The patient or assisting individual can sign in which can include identification information, de-identified information, biometric information, each of which can be unique that can be received by the controller at 600. The system can perform a warm-up phase with the machine and then perform a series of repetitions to determine an estimated one repetition maximum (1RM) at 602. 1RM can represent the most load or resistance that can be performed by the patient with maximum effort from the patient in a single repetition. The system can predict the 1RM using methods such as multiple repetition maximum assessments, load-velocity analyses, and historical patient data or aggregate patient data or the like. For example, using the multiple repetition maximum method, the patient can work up to a heavy load and have them perform as many repetitions as possible. The system can then use that load, number of reps, and/or velocity to estimate what their one repetition max would be. This information can be used to identify current strength levels and any of these processes can be completed on both limbs at the same time or on each limb individually.

According to the patient information that is provided to or retrieved from the controller using one of the methods above for determining an estimated 1RM, a load is determined for the power test at 604. In one embodiment, the health care assistant, trainer or practitioner can choose to run the power test up to a maximal strength load (1RM) or they may choose to run the test at a lower or higher load depending on the capabilities of the patient and the recommendations of the computer readable instructions. With the collection of data, the aggregate dataset can also allow the system to provide an estimation based on the dataset. The system can also use characteristics of the patient, determine datasets that are from patients with similar characteristics and provide estimated or initial treatment plans for the new patient.

Therefore, the system can use machine learning to develop initial power test loads from historical data collected. As the system develops these initial power test loads and presents these to the health care assistant, trainer or practitioner, the system can receive modifications to the initial plans. These modifications can be used to provide subsequent evaluation plans. For example, if an initial evaluation plan is developed for a patient with certain characteristics and sets an initial load at X, the health care provider may modify this load to Y. Therefore, if the modifications occur routinely, or for a certain patient, the system can provide subsequent evaluation plans with the load of Y, learning from the modifications of the health care provider.

A power test can include an assessment that takes a patient through several repetitions (e.g., in the range of 5 to 20) of gradually increased resistance leading up to a maximal load that was entered by the health care assistant or practitioner. This assessment can provide data on velocity, power, force, range of motion, work etc. and generate the data that is shown in the Figures (e.g., FIG. 7) for each limb individually. The patient or assisting individual can determine if the exercise will be unilateral or bilateral at 606 and provide input to the system, such as the controller, accordingly. A maximal load can be entered into the system. This load can be used to determine the repetition loads that will gradually increase as determined by the computer readable instructions. The controller is provided with the load or resistance at 608, the test starts at 610 and the patient particulates in the exercise at 612 until the test is complete at 614. In one example, the patient can complete one repetition at a time as fast as possible and then receives a rest period before completing the next rep. This example can be used to take the patient through several repetitions of a gradually increasing load leading up to the resistance that was entered, or until the practitioner ends the assessment. The computer readable instructions can also determine the increase in the load according to a predetermined protocol or according to the real-time data received from each repetition from the patient.

The system can also learn from the performance of one or more patients so that during an evaluation, the system can suggest incremental load increases or other modifications to the plan during the implementation of the evaluation. Evaluations with more accurate and reliable data sets can be used to provide suggestions for subsequent evaluation plans.

The data that is gathered during this power test is transmitted to one or more computer systems, locally or remotely. The computer system can receive data from other systems including healthcare provider systems. For example, patient criteria can be received from the medical record of the patient and can be used for the initial evaluation as well as the subsequent workout scheme and rehabilitation. The assessment data can be associated with the patient record and can also be associated with each type of activity, exercise and machine including leg press, chest press, leg curl, upper row, other machines and any combination. A maximal load for each test can be received or calculated from this information as well as power velocity, peak power and other data points that can be received and used by the system for each limb.

Figure 7:
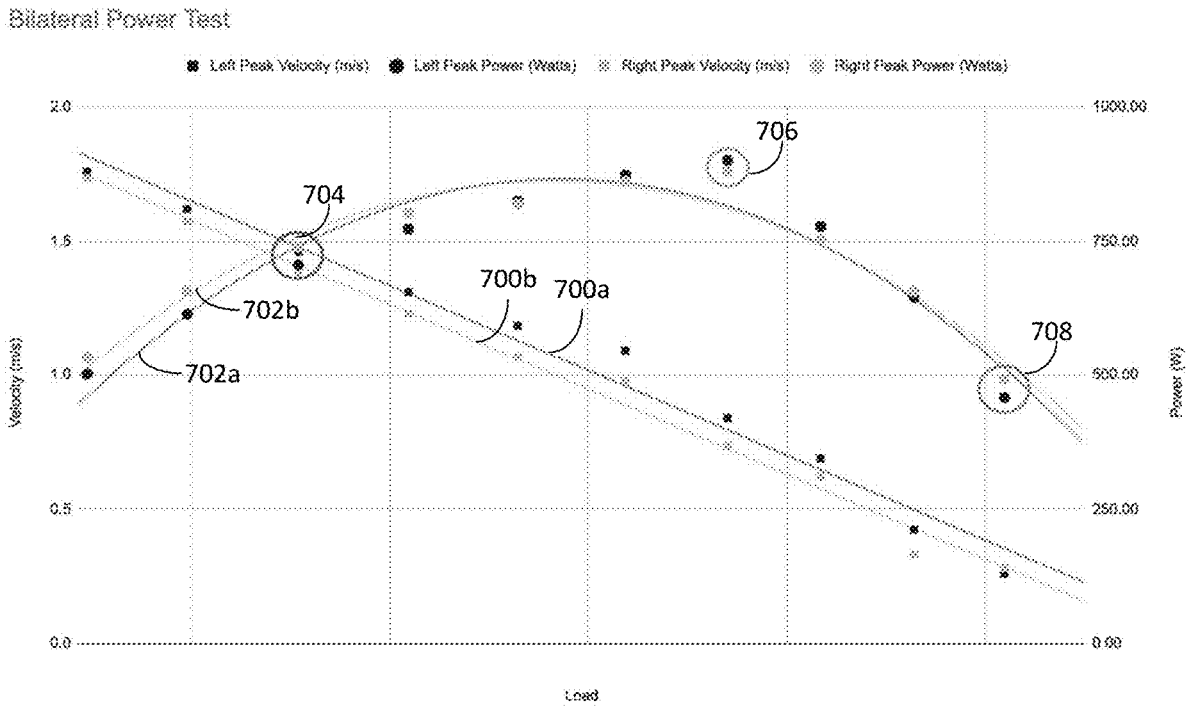
FIG. 7 is a graphical representation of aspects of the present system.

The system and the computer readable instructions can evaluate the power test completed on one or both limbs. In one embodiment, the data from the series of repetition completed within a power assessment can be plotted. The variables included in the plots can be velocity, power, resistance, force, and the like. Referring to FIG. 7, the data that is collected from the assessment is shown. The velocity (in meters per second) of the left limb is shown as 700*a* and the right limb as 700*b*. The power (e.g., Watts) for the left limb is shown as 702*a* and the right limb as 702*b*. In one embodiment the lines of best fit can be determined for the left and right limbs' force-velocity relationship shown below. Further, a best fit analysis can be determined for the left and right limbs' power. Further, a best fit can be determined using data from the power test on that specific leg. All the data can be normalized prior to analysis.

The system can determine a line of best fit for left and right force-velocity relationships with the following equation:

$$y = mx + b$$

where y is the y-axis, m is the slope, x is the x-axis and b is the y intercept of a straight line.

The system can determine the line of best fit for left and right power relationships represented by the curves 702*a* and 702*b*. The best fit of the power curve can be determined by several methods including the following that can be implemented in computer readable instructions as an example:

$$y = Ax^2 + Bx + C$$

where y is the dependent variable, x is the independent variable, a is a coefficient, b is a coefficient, and c is a coefficient. Any number of methods can be used for the best fit and can include generating one line that minimizes the distance between the line and the gathered data for each limb. Therefore, this graph can show all power data and are not specific to peak power or power velocity and these points can be determined from the line(s). The data can be analyzed by the individual data points as well as any part of each line of best fit (for each limb). The differences between limbs at any one point or across several points can be calculated as bilateral differentials.

Peak power and power velocity can be represented by two points determined from the test data of each limb. These points can be visually determined and/or numerically defined from an algorithm. The value that is used for calculating the power velocity point and the power velocity bilateral differential can be in a range that can include point 704 where the power line and the velocity line intersect. These points can be determined from each leg individually (e.g., right leg power velocity and left leg power velocity). The power velocity points can have a corresponding force, load, average wattage, peak wattage, average velocity, and peak velocity and the like. The peak power and peak power bilateral differential can be calculated at 706 which can be the highest data point of power output. The peak power and peak power bilateral differential could also be calculated from the highest point of the power curve (line of best fit). These points can be determined from each leg individually (e.g., right leg peak power and left leg peak power). The peak power point can have a corresponding force, load, average wattage, peak wattage, average velocity, and peak velocity and the like. The maximal load can be calculated at 708 where the last successful repetition performed by the patient occurs or can be estimated based on the previous repetitions completed. These points can be determined from each leg individually (ie. right leg maximal load and left leg maximal load). The maximal load point can have a corresponding force, load, average wattage, peak wattage, average velocity, and peak velocity and the like. The system can provide and display strength, peak power and power velocity data as this data can be identified and compared between tests completed at different points in time. The power velocity, peak power, and maximal load points can be used to determine training loads, measuring physical functional ability, and the assist with a risk assessment of the potential for further injury or health risk.

It should be noted that bilateral differentials do not have to be specific to strength, peak power, or power velocity but rather can show an average across all or some repetitions. In one embodiment, an average power bilateral differential can be calculated by averaging repetitions involving high velocities and lesser forces. An average strength bilateral differential can be calculated from repetitions involving lower velocities and higher forces.

In the case that the machine is the leg press, strength can be calculated for both limbs and for each limb separately. In one embodiment, the system can identify the strength levels including the current level as well as an ideal level, if appropriate. The ideal levels can be calculated based upon the body weight ratios of the patient so that the specific patient characteristics are used to determine these levels. Specific patient characteristics can include age, injury type, degree of injury, weight, height, medical history, and the like.

In one embodiment, current strength can be the estimated 1RM that was determined from the maximal exertion test, the final repetition performed on the power test, or an estimation from the dataset. The system can determine the current strength level of both legs or each leg individually, ideal strength level of both legs or each leg individually, and bilateral differentials (e.g., difference between legs across one or more repetitions) and display the information in graphical format as shown in the Figures. For example, a male patient's ideal bilateral leg press may be a factor of (such as four times) the patient's body weight. Different algorithms can exist for each piece of exercise equipment. In addition, ideal levels for peak power and power velocity can be determined based on a percentage of ideal strength.

The system can also determine the current peak power level of both limbs or each limb independently. The system can also determine bilateral differentials at peak power. The system can also determine ideal peak power levels, if applicable. For example, if your ideal strength for leg press is 400 pounds your ideal Peak Power level could be 75% of that (e.g., 300 lbs.)

The system can also determine the current power velocity of both legs or each leg individually. The system can also determine bilateral differentials at power velocity. The system can also determine ideal power velocity levels, if applicable. For example, if your ideal strength for leg press is 400 pounds your ideal power velocity level could be 55% of that (e.g., 220 lbs.)

These values, strength, peak power, and power velocity can be determined for various machines representing different parts of the patient and can include use of leg press, chest press, leg curl, upper row, latissimus dorsi (lat.) pulldowns, military presses, core rotations, leg extensions, deadlift, other work out machines and any combination.

In the case of a neurologic or neuromuscular impairment these points (maximal strength, peak power, power velocity) will typically be identified from unilateral power tests because it is expected that there will be large discrepancies between the data for each limb. This means that there can be a peak power point and a power velocity point for the right limb and for the left limb. These points can include data on force, load, velocity, wattage, range of motion, and others. These points can provide markers for comparison and interpretation. As an example, for stroke patients, the system can assist with bringing power velocity of the injured leg up to the same as the uninjured leg so that the load, velocity, and wattage of the previously injured leg is equal to that of the uninjured leg. Additionally, the system can assist with achieving equal peak power and strength between the limbs. Therefore, this system can assist the patient to maximize their own ability without assistance from a trainer, or the like.

Each machine that can be used by the patient can be used in communications with the system and follow the same processes and functionality provided by the system as described where with each machine having the ability to provide its own set of data. In one embodiment, ideal strength, peak power and power velocity levels can differ per machine. In one embodiment, the patient's current values (e.g., strength, peak power, power velocity, etc.) can be determined for each machine regardless of what machine is used.

From these data points from one or more machines, the system can calculate a multi-quadrant evaluation of the patient. For example, these assessments, evaluations, and calculations can be determined for the right side above the waist, right side below the waist, left side above the waist, left side below the waist and any combination as well as left and right-side core (trunk). These assessments, evaluation and calculations can be determined for the right arm, left arm, right leg and left leg, right core and left core and any combination.

From these evaluations, rehabilitation plans can be created or modified. According to the evaluation and assessment, the rehabilitation program can be determined for each quadrant and for each machine or exercise. For example, in the case that the patient has a weaker left leg than right leg, an occurrence that can result from a stroke, the system can design a rehabilitation plan that includes a slower and lesser load or resistance profile for the weaker leg designed to rehabilitate the weaker leg to the same strength level of the stronger leg as well as improve the strength bilateral differential. The system can also design a rehabilitation plan that improves strength levels and strength symmetry (strength comparisons across body quadrants, ie. lower push and lower pull strength) and reduces variance across multiple machines. The system can also create or modify a rehabilitation plan that seeks to improve peak power and reduce bilateral differentials as well as increasing symmetry and reducing variance across multiple machines. The bilateral differentials can be reduced for the repetition at which peak power occurs and across several repetitions (average power differential). The system can also create or modify a rehabilitation plan that seeks to improve the power velocity and reduce bilateral differentials. The system can also design a rehabilitation plan that seeks to increase power velocity levels and power velocity symmetry and reduce variance across multiple machines. The bilateral differentials can be reduced for the repetition at which power velocity occurs and across several repetitions (average power differential). Training programs may be designed for one or more of the above-mentioned goals.

From the initial assessment and evaluations, rehabilitation programs are created. For example, a rehabilitation program may include strength and power training, motor skill exercises, mobility training, constraint induced therapy, range of motion therapy, electrical stimulation, and the like.

When a patient is using the system, the system can learn from the patient's use and data gather so that the rehabilitation protocol can change over time and be specific to that patient. One example would include the patient completing a bilateral power test over a series of repetitions, ten in this example, with data collected for each repetition and the data from the left and right limb can be compared. When evaluating the power velocity point, it would be expected to see that the injured limb would have a power velocity point at a lower load (for example in an earlier repetition) than the uninjured limb. This power velocity point be can designated as the first target. It can then be decided to begin the training of the injured limb at this power velocity load. The system can then take a stair-stepper approach to increasing velocity and then increasing load until the patient shows that the injured limb is at the same power velocity load and wattage as the uninjured limb. This process can be autoregulated by the computer based on real-time data feedback. For example, if the patient is exceeding their previous wattage by more than 10%, the computer can automatically adjust their resistance to a higher load. While the progression is determined by the patient's progress and the computer readable instructions learning from the process, an illustrative example of the process is shown below.

The system determines that the power velocity load for the uninjured limb is 125 lbs. The power velocity load for the injured limb is 90 lbs. From this information the following can be calculated by the system:

Week 1: 2 sets of 8 repetitions at 90 lbs. load; 1 set of 8 consecutive repetitions at 90 lbs. load; and 2 sets of 8 repetitions at 95 lbs. load.

Week 2: 1 set of 8 repetitions at 90 lbs. load; 1 set of 8 repetitions at 95 lbs. load; 1 set of 8 consecutive repetitions at 95 lbs. load and 2 sets of 8 repetitions at 100 lbs. load.

Week 3: 1 set of 8 repetitions at 95 lbs. load; 1 set of 8 repetitions at 100 lbs. load; 1 set of 8 consecutive repetitions at 100 lbs. load and 2 sets of 8 repetitions at 105 lbs. load. As can be seen, the system allows for targeting their training exactly where their current ability is and allowing for progression over time. These programs can be automatically modified on a rep-by-rep, set-by-set, or day-by-day basis due to measured changes in performance.

The computer readable instructions can develop a rehabilitation plan designed to restore functionality in that individual. For example, in stroke patient, and to describe the goals graphically, the rehabilitation plan can be designed to bring the lower performing limb (e.g., lower curve or line) up to the level of the other limb by seeking to increase the velocity and power output of the impacted limb. Using the rehabilitation programs, data from the equipment, exercises, and the continuing modifications of the rehabilitation plan, neuroplasticity in the patient can be improved and the recovery time shifted with improved final performance including improved functioning of the impaired limb and overall functional ability. By assessing both limbs (either at the same time or with separate assessments), a customized initial performance baseline for the particular patient can be established as the system can determine the strength, peak power, and power velocity of an impaired limb compared with the un-impaired limb. Further, as the patient and system interact, the system can determine the difference in improvements of the un-impaired limb so that as the impaired limb improves, the relative improvement compared with the un-impaired limb can be determined to provide a more accurate depiction of the progress of the patient. Further, in the event that the previously un-impaired limb becomes impaired, the system can detect the reduction in the limb and report accordingly. For example, the system can show that the previously un-impaired limb has a reduction in strength, peak power or power velocity and can notify the patient or assisting individual accordingly so that the system does not artificially report improvement in the impaired limb based upon a reduction in the un-impaired limb.

Figure 8A:
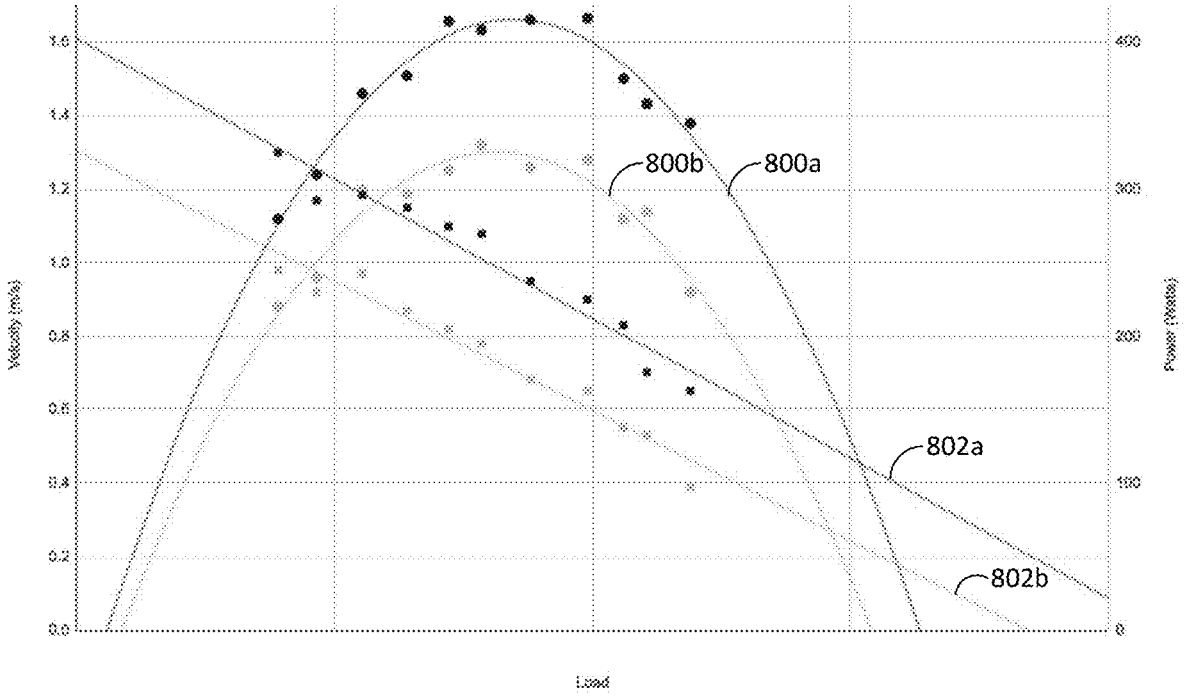
FIG. 8A is a graphical representation of aspects of the present system.
Figure 8B:
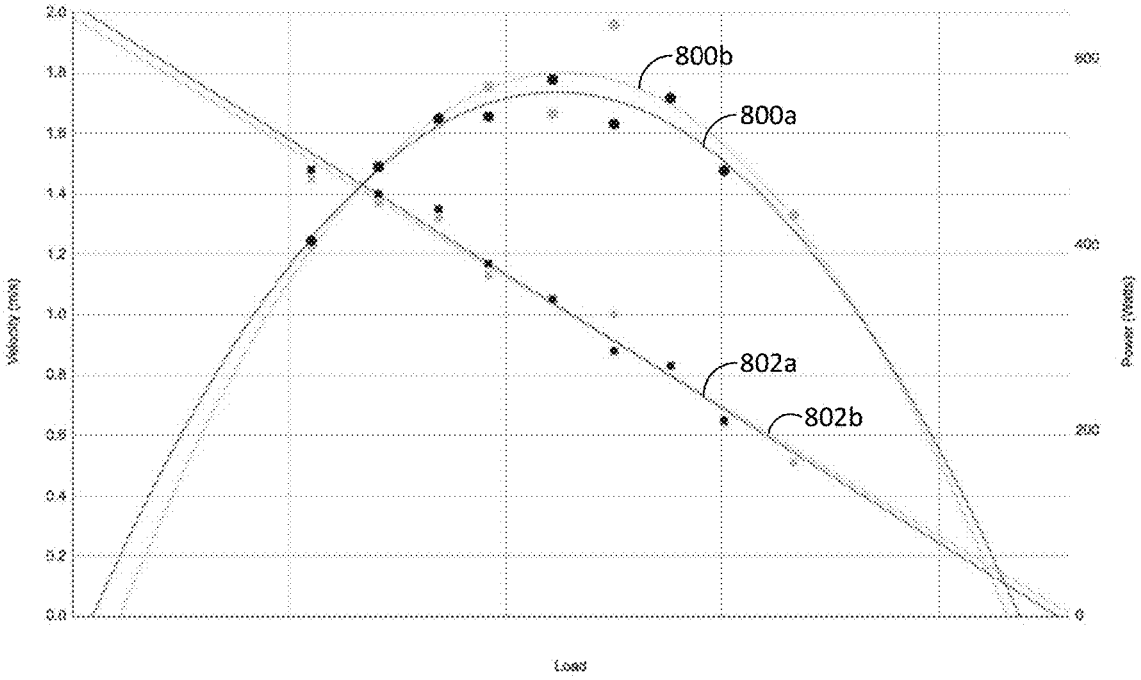
FIG. 8B is a graphical representation of aspects of the present system.

Once the assessment is performed and the baseline of performance established according to the un-impaired limb, the rehabilitation plan is created with the goal of the impaired limb being exercised so that the neurological system of the patient is actuated to increase the neural output of the patient and improve the power production of the impaired limb. Referring to FIGS. 8A and 8B, the graphical results of an assessment and evaluation session of a patient as shown. In this example, the left power 800*a* and the left velocity 802*a* show that the left leg is un-impaired. The right leg, however shows lesser values and the difference in the performance analysis can be seen. The right leg power output is 800*b* and the right velocity is 802*b*. After the patient is implementing the rehabilitation plan or has completed the rehabilitation plan, FIG. 8B shows that the power outputs and velocity of each leg is more similar post rehabilitation.

In one embodiment, the rehabilitation plan can include additional processes and equipment including surface muscle stimulation or transcranial magnetic stimulation which can improve and accelerate the regeneration of neural pathways. Electrical stimulation can elicit greater nervous system recruitment by activating motor neurons that may currently be inhibited under voluntary activation. For example, electrical stimulation may be used on a patient's quadricep when completing their leg press exercise. This would allow them to recruit more motor units and produce more force and velocity.

A rehab plan can be created based on information from their performance evaluation as well as injury information (e.g., type of injury, date of injury, degree of impairment, location of impairment, current functional ability). Based on the information, the patient can begin an appropriate exercise protocol that aligns with the collected information. Once exercise protocol is underway the sessions can be automatically adjusted based on performance allowing for a completely individualized plan according to their progress.

It is understood that the above descriptions and illustrations are intended to be illustrative and not restrictive. It is to be understood that changes and variations may be made without departing from the spirit or scope of the following claims. Other embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventor did not consider such subject matter to be part of the disclosed inventive subject matter.

What is claimed is:

1. A system for dynamically implementing a rehabilitative schema for neuromuscular and neurologic disease and injury comprising:

an exercise machine having a load assembly for applying a first load on a first limb of a patient and applying a second load on a second limb of the patient;

a first load sensor adapted to determine a first force applied to the first limb by the patient;

a second load sensor adapted to determine a second force applied to the second limb by the patient;

a first velocity sensor for receiving a first velocity information associated with the first force;

a second velocity sensor for receiving a second velocity information associated with the second force; and, computer system in communication with the first load sensor, the second load sensor, the first velocity sensor, the second velocity sensor and adapted to determine a base line power for the first limb and the second limb according to the first force, the second force, the first velocity information, and the second velocity information receive an initial treatment program, and determine a modification to the initial treatment program according to receiving a subsequent force and a subsequent velocity information, determine a bilateral differential between the first limb and the second limb based on the base line power, and modify the initial treatment program to reduce the bilateral differential until power velocity alignment between the first limb and the second limb is achieved.

2. The system of claim 1 wherein the computer system is adapted to determine an estimated maximal load.

3. The system of claim 1 wherein the computer system is adapted to determine a peak power and power velocity.

4. The system of claim 3 wherein the computer system is adapted to determine a peak power and a power velocity for each limb.

5. The system of claim 1 wherein the computer system is adapted to determine the modification of the initial treatment program according to an iterative process using a set of date data received from the first load sensor, the second load sensor, the first velocity sensor and the second velocity sensor to provide a subsequent treatment program.

6. The system of claim 1 wherein the computer system is adapted to repeat an iterative process for each subsequent patient workout session.

7. The system of claim 1 wherein the computer system is adapted to determine the initial treatment program according to a patient's characteristics.

8. The system of claim 1 wherein the computer system is adapted to determine the initial treatment program according to a dataset of prior patient characteristics.

9. The system of claim 8 wherein the computer system is adapted to determine the initial treatment program according to a record from a past patient dataset wherein a current patient characteristic matches a prior patient characteristic in the past patient dataset.

10. A system for dynamically implementing a rehabilitative schema for neuromuscular and neurologic disease and injury comprising:

an exercise machine having a load assembly for applying a first load and a second load;

a sensor assembly adapted to measure a performance dataset that include a first force and a second force placed laterally against the first load and the second load by a patient using the exercise machine and a first velocity and a second velocity associated with the first force and the second force; and, a computer system in communication with the sensor assembly adapted to determine a base line power according to the performance dataset, create an initial treatment program, and determine a modification to the initial treatment program according to receiving a subsequent dataset from the sensor assembly, determine a bilateral differential between a first limb and a second limb of the patient based on the base line power, and modify the initial treatment program to reduce the bilateral differential until power velocity alignment between the first limb and the second limb is achieved.

11. The system of claim 10 wherein the computer system is adapted to determine performance metrics according to the performance dataset and the subsequent dataset.

12. The system of claim 10 wherein the computer system is adapted to determine an estimated maximal load.

13. The system of claim 10 wherein the computer system is adapted to determine a peak power.

14. The system of claim 10 wherein the computer system is adapted to determine a power velocity.

15. The system of claim 10 wherein the computer system is adapted to determine a symmetrical comparison between a first limb and a second limb.

16. The system of claim 10 wherein the computer system is adapted to determine the modification to the initial treatment program according to a determination of a peak power, a power velocity, a symmetry comparison, and any combination thereof.

17. A system for dynamically implementing a rehabilitative schema for neuromuscular and neurologic disease and injury comprising:

an exercise machine having a load assembly for applying a first load and a second load laterally to a patient;

a sensor assembly adapted to determine a performance dataset that include a first force and a second force placed on the exercise machine applied by the patient and a first velocity and a second velocity associated with the first force and the second force; and, a computer system in communication with the sensor assembly adapted to determine a base line power according to the performance dataset, create an initial treatment program, and determine a modification to the first load and the second load according to receiving a subsequent dataset from the sensor assembly, determine a bilateral differential between a first limb and a second limb of the patient based on the base line power, and modify the first load and the second load to reduce the bilateral differential until power velocity alignment between the first limb and the second limb is achieved.

18. The system of claim 17 wherein the computer system is adapted to vary the first load according to the modification to the first load.

19. The system of claim 17 wherein the modification to the first load is according to a determination of a peak power, a power velocity, a symmetry comparison, and any combination thereof.

20. The system of claim 17 wherein the modification to the first load is iterative until an alignment of a right power velocity calculation and a left power velocity calculation occurs.

* * * * *